US005722796A

United States Patent [19]

Halvorsen et al.

[11] Patent Number: 5,722,796

[45] Date of Patent: Mar. 3, 1998

[54] HINGE-OVER SUBSEA TEMPLATE PRODUCTION SYSTEM

[76] Inventors: Tore Halvorsen, Otto Sverdrups VE1 6A, 3600 Kongsberg, Norway; Jimmy Andrews, 1 Ridgeway Close, Unit 13-01, Liholiho Rise, Singapore, 1027; Luis Antonio Gomes Araujo, 67B Cumberland Street, Edinburgh, Scotland, EH3 6RD; Sverre Corneliussen, Lovasvelnen 3; Christopher E. Cunningham, Schlanbaxchevi 16, both of 3600 Kongsberg, Norway; Martin Faella, Meieviveien 10, N-3023 Drammen, Norway; Kaj Hugo Fredriksen, Aslyparken 24, 3215 Sandefjord, Norway; Nicholas Gatherar, 6(IFI) West Preston Street, Edinburgh, Scotland, EH8 9PX; Olav Inderberg, Venngsdalsveien 99; Asmund Lauvli, Haavenga, both of 3600 Kongsberg, Norway; Michael Graham Morgan, 18 Dunfermline Road, Limekilns, Fife, Scotland, KY11 3JS; James Tait, 6 Royal Scot Way, Dunfermline, Scotland, KY12 OPS

[21] Appl. No.: 834,698

[22] Filed: Apr. 1, 1997

Related U.S. Application Data

[63] Continuation of Ser. No. 322,248, Oct. 12, 1994, abandoned.

[30] Foreign Application Priority Data

Nov. 30, 1993 [GB] United Kingdom ..... 9324530

[51] Int. Cl.[6] ..... E21B 43/017; E02B 17/02

[52] U.S. Cl. ..... 405/195.1; 405/227; 405/224; 166/341; 166/349

[58] Field of Search ..... 405/227, 204, 405/169, 165, 195, 224; 166/341, 349, 366

[56] References Cited

U.S. PATENT DOCUMENTS

| | | | |
|---|---|---|---|
| 3,553,821 | 1/1971 | Postlewaite | 166/349 X |
| 3,672,447 | 6/1972 | Kofahl | 166/338 |
| 3,934,658 | 1/1976 | Nelson | 405/204 X |
| 4,126,008 | 11/1978 | Dixon | 405/227 X |
| 4,155,672 | 5/1979 | Franks | 166/338 X |
| 4,344,721 | 8/1982 | Goldsmith | 166/341 X |
| 4,519,727 | 5/1985 | Mitchell et al. | 405/227 X |
| 4,822,212 | 4/1989 | Hall et al. | 405/227 |
| 5,040,607 | 8/1991 | Cordeiro et al. | 405/227 X |

FOREIGN PATENT DOCUMENTS

| | | |
|---|---|---|
| 2003533 | 3/1979 | United Kingdom . |
| 2044319 | 10/1980 | United Kingdom . |
| 2046330 | 11/1980 | United Kingdom . |
| 2202257 | 9/1988 | United Kingdom . |

*Primary Examiner*—Tamara L. Graysay
*Assistant Examiner*—Frederick L. Lagman
*Attorney, Agent, or Firm*—Henry C. Query, Jr.

[57] ABSTRACT

A subsea system comprises a central template that is piled into the seabed and carried wing modules that are connected to the template by hinges. This allows the template to be deployed and the wing modules attached subsequently or for the wing modules to be folded upwardly into a collapsed disposition as the template is deployed. In either case, the template can be deployed through the moonpool of a vessel and does not require a heavy lifting barge. An example of a module usable with the template is a hinge-over guidebase which can allow the commencement of drilling of a well while a manifold and christmas tree are being constructed for subsequent attachment. Thus, installation of the system is easy and drilling of the well can commence quickly.

43 Claims, 11 Drawing Sheets

HINGE-OVER SUBSEA TEMPLATE PRODUCTION SYSTEM

This application is a continuation of application Ser. No. 08/322,248, filed Oct. 12, 1994, now abandoned.

BACKGROUND OF THE INVENTION

The invention relates to subsea systems and more particularly to subsea template systems.

The drilling of an oil well requires guidance of the drill string during initial drilling and subsequent drilling and completion of the well by installation of a christmas tree to control flow from the well. In addition, other subsea equipment may be required such as a manifold, a pig launcher, and a flowline pull-in for the hook-in of flowlines and umbilicals.

Such equipment has previously been mounted on the seabed on one of a number of different forms of template. For example, the paper "The Conversion of a Two-Well Modular Guidebase with Shared Posts to Subsea Production" by S. D. Gomersall and J. M. Hopkinson presented at the Offshore Technology Conference in Houston, Tex. May 7–10, 1992 describes a template for mounting such equipment and drilling eight spaced wells. As stated in the paper, the weight of the template was 650 tonnes and it is likely that its maximum dimension would have been in excess of 30 meters.

A template of this kind is shown in EP-A2-293251 which describes a template which has a width and length of 15 meters (50 ft.) by 24 meters (80 ft.) and a height of 6 meters (20 ft.).

Such a template can only be deployed using a heavy lifting crane mounted on a lifting barge and may require the use of divers to make the required interconnections. The size of the template means that to design and build it may take a number of years and, since drilling cannot commence until the template is in position, this can delay correspondingly the commencement of production. There have been proposals for smaller templates of this type (4 wells) but these have substantially the same problems as outlined above.

In an alternative proposal, the template does not provide guidance during drilling but is centrally located in location to a number of adjacent wells providing equipment for the common servicing of those wells. This allows drilling to commence before the template is installed, but the template still requires a heavy lifting barge for its installation. In addition, there are a larger number of connections to be made than with the first mentioned proposal and these require significant use of divers or remotely operated vehicles and tools to make the connections.

Sonsub Inc. have published details of a subsea drilling and production system which provides a production template for two or four wells. The template is of unitary construction with drill centralizers provided around a core. In one arrangement, the template is generally rectangular with a centralizer hole at each corner and in another embodiment it is rectangular with two centralizers provided on opposite sides of a central core. It is likely that this will also require a lifting barge for its deployment.

"Subsea Engineering News" of 4th Nov. 1993 contains an article on work by Exxon Production Research on a manifold for 7 wells called a "DMac" manifold which is stated to be able to be run through the moonpool of a drilling rig. However, no other details are known of this proposal.

The paper by Gomersall and Hopkinson also describes the incorporation into their template of two "off template" wells drilled before installation of the template. This is achieved by using well head spools on these wells which are bolted to the template.

SUMMARY OF THE INVENTION

According to a first aspect of the invention, there is provided a subsea system comprising a template having an upper support for equipment and a mounting for landing the template on a base, the template including at least one hinge member for connection to a module such that the module can be pivoted relative to the template from a collapsed disposition to a deployed disposition.

According to a second aspect of the invention, there is provided a method of deploying a subsea system comprising arranging a template over a moonpool of semi-submersible vessel, lowering the template to the seabed through the moonpool and then arranging a module to project laterally from the template via a hinged connection therebetween.

By using a template with at least one hinged module, the template can be lowered to the seabed through the moonpool of a semi-submersible vessel. The module is then deployed from the template. This avoids the need for heavy lifting gear. In addition, it may allow work to commence on well drilling before completion equipment and christmas trees have been built and designed so allowing earlier commencement of well drilling.

The following is a more detailed description of some embodiments of the invention, by way of example, reference being made to the accompanying drawings in which:

DETAILED DESCRIPTION OF THE PREFERRED EMBODIMENTS

Figure 1:
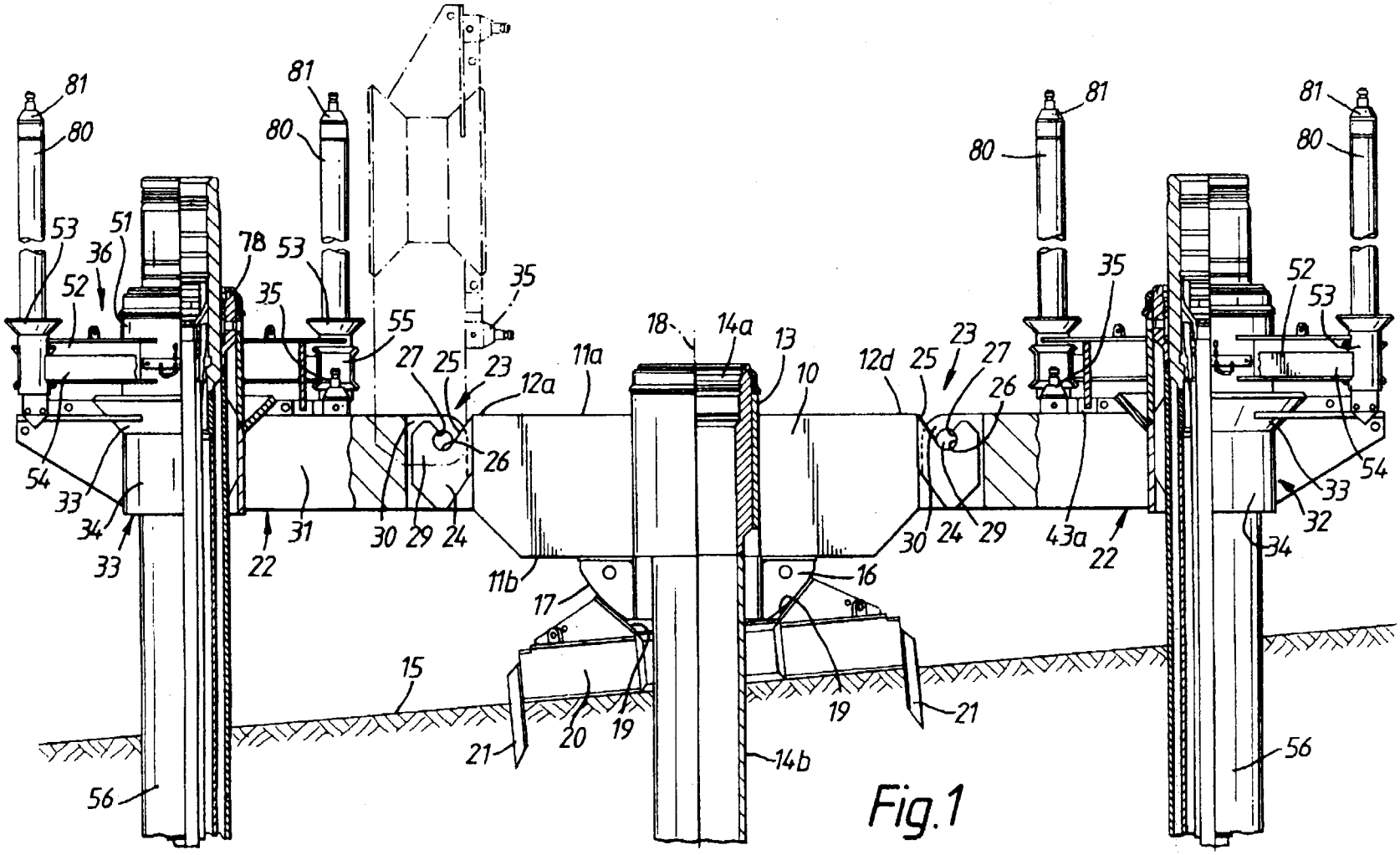
FIG. 1 is a side elevation of a first form of system for drilling new wells and including a template and associated hinge-over guidebase modules in a deployed position on the template, the system being mounted on the seabed and one hinge-over guidebase being shown in broken line in a collapsed disposition.

The first form of system comprises a template best seen in FIG. 1, indicated generally at 10 of generally rectangular shape with upper and lower surfaces 11*a*, 11*b* and four side edges 12*a*, 12*b*, 12*c*, 12*d*. An annular pile housing receptacle 13 extends through the center of the template and has an axis normal to the plane of the template 10.

A pile housing 14*a* attached to an end of a pile 14*b* is fixed in the pile housing receptacle 13 and extended from beneath the template 10. Typically, the pile 14*b* may be formed by connected sections of a tube of 760 mm (30 inches) diameter with a length of 50 meters and a wall section of 50 mm (2 inches). The pile 14*b* extends vertically into the seabed 15 and is cemented in position to support the template 10 above the seabed.

As seen in FIG. 1, the seabed 15 may not be horizontal and in this case the lower surface 11*b* of the template 10 carries a gimbal 16 through the which the pile 14 extends and which has curved surfaces 17 lying on radii about the pile axis 18. These surfaces 17 engage with a co-operating frusto-conical surface 19 on a temporary guidebase 20 through which the pile 14 also passes and which has spikes 21 to hold the temporary guidebase 20 on the seabed 15. In this way, the template 10 may be rotated relative to the seabed until it is horizontal. A leveling mechanism (not shown) may be provided for determining when this orientation is achieved.

Two guidepost receivers (not shown) are provided on the template 10 adjacent respective opposite side edges of the template 10 for a purpose to be described below.

The template 10 carries up to 5 hinge-over guidebases indicated generally at 22. The connection between each hinge-over guidebase 22 and the template is via a hinge 23, best seen in FIGS. 1, 2 and 3.

Each hinge 23 comprises two hinge pads, one carried on the template 10 and one carried on a hinge-over guidebase 22. The template 10 has six such hinge parts 24. There are two on each of two opposite side edges 12*a*, 12*c* of the template 10 and one on each of the other two opposite side edges 12*b*, 12*d*. Each hinge part 24 on the template 10 is generally hook-shaped and is provided with a downwardly sloping guide surface 25 which leads to one end of a semi-circular eye 26 whose other end is provided with a tangentially extending surface 27 that extends parallel to the sloping guide surface 25 and also extends beyond the horizontal.

The hinge part 28 on each hinge-over guidebase 22 comprises a circular cross-section bar 29 held between spaced plates 30. The bar 29 extends in a direction generally normal to the length of the hinge-over guidebase and is dimensioned to fit into the guide 25.

In this way, each hinge-over guidebase 22 is connected to the template 10 by a hinge 23 that allows pivotal movement of each hinge-over guidebase 22 about a horizontal axis between the broken line position shown in FIG. 1 and the full line position shown in FIG. 1, i.e. from a position in which the hinge-over guidebase 22 is disposed vertically to a position in which the hinge-over guidebase 22 extends laterally from the template 10. Each hook-shaped hinge part 24 projects from a plate such that when the associated guidebase 22 is disposed horizontally the plates 30 of the other hinge part 28 engage the plate to prevent further downward rotation of the guidebase 22.

Figure 2:
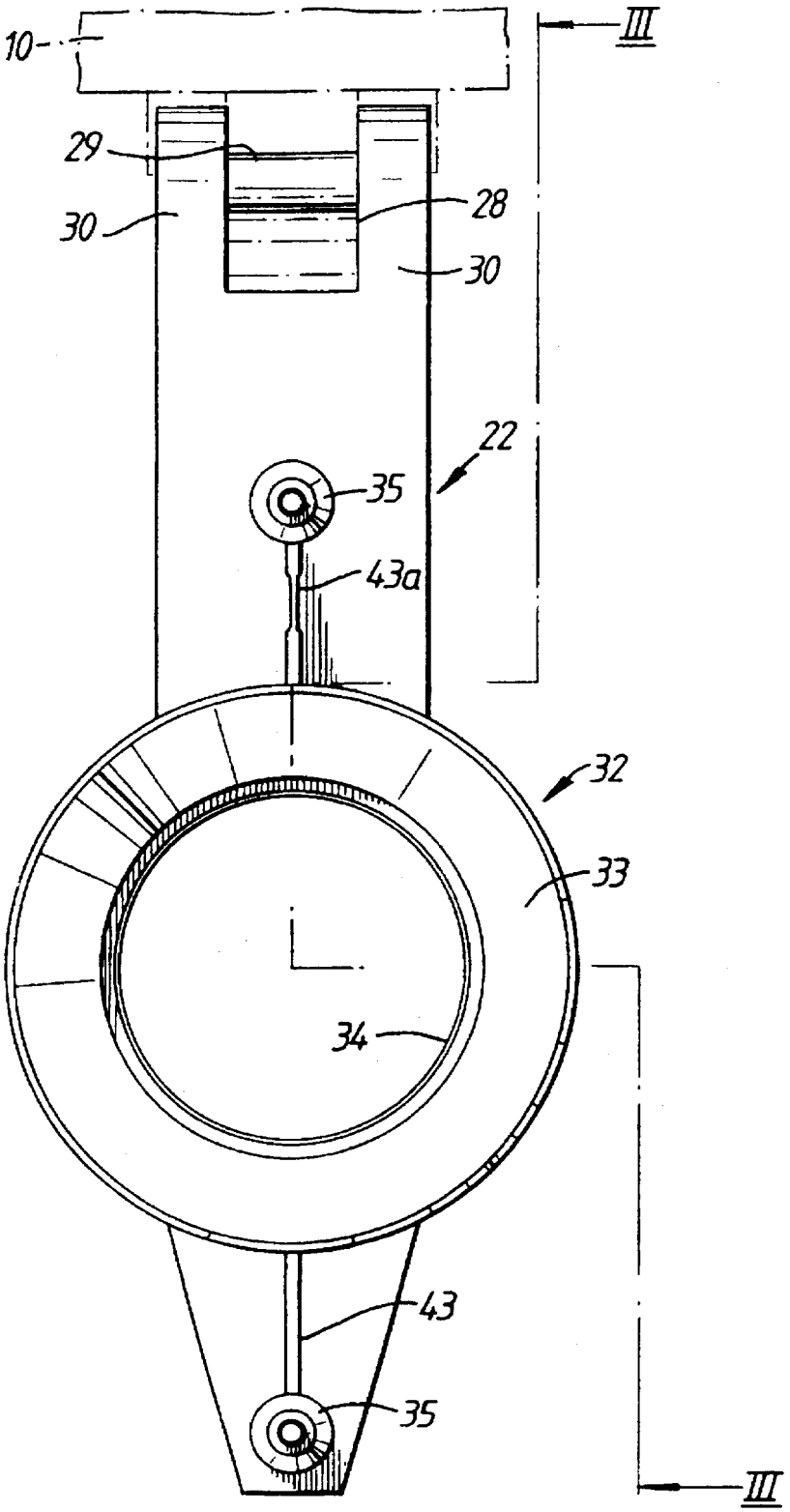
FIG. 2 is a plan view of a hinge-over guidebase of the system of FIG. 1.
Figure 3:
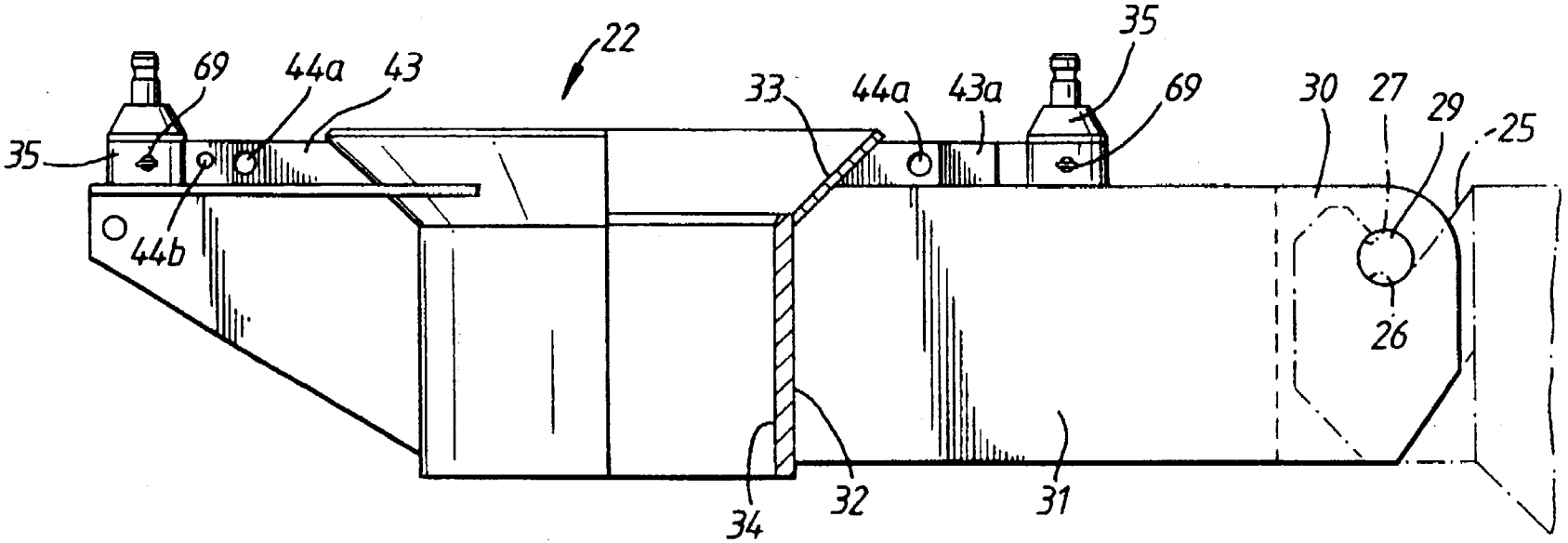
FIG. 3 is a section on the line III—III of FIG. 2.

Each hinge-over guidebase 22 is, as seen in FIGS. 2 and 3, formed by an elongate beam 31 which has the hinge part 28 at one end and carries an annular centralizer 32 formed by a frusto-conical entrance 33 leading to an annular aperture 34. The centralizer 32 is for guiding and holding a casing string in a manner to be described below.

Each hinge-over guidebase 22 has an upper surface carrying a pair of guidewire connectors 35 spaced on diametrically opposite sides of the centralizer 32. Each connector 35 is connected to the guidebase 22 by a shear pin (not shown).

Each connector 35 is connected to the entrance 33 of the centralizer 32 by a flange 43. One flange is provided with a single hole 44*a* and the other flange is provided with two spaced holes 44*a*, 44*b* for a purpose to be described below. Each flange 43 includes a portion 43*a* which is machined to a predetermined width for a purpose to be described below.

Figure 7:
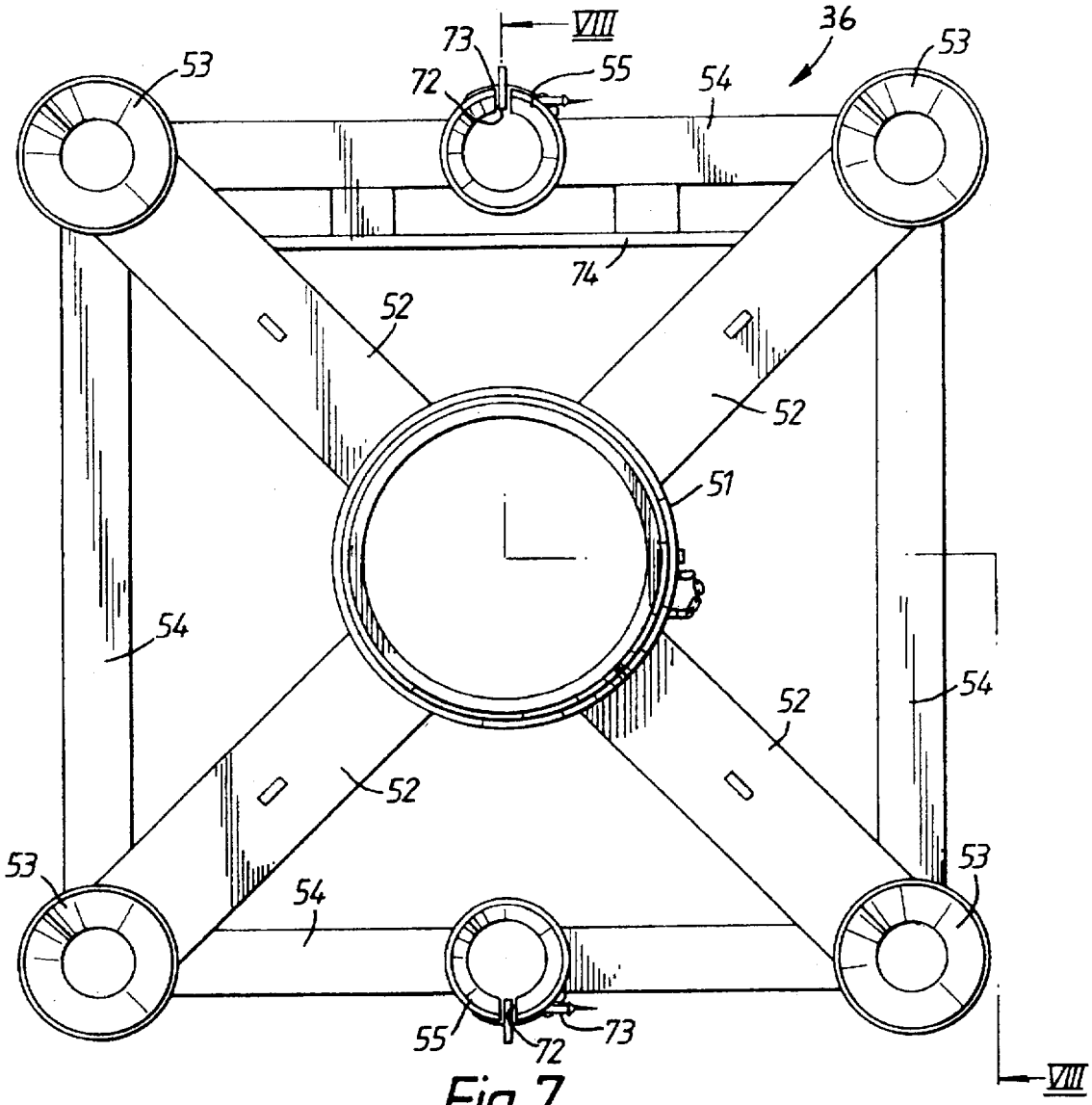
FIG. 7 is a plan view from above of a completion guide base for mounting on a hinge-over guidebase of the template of FIGS. 1 to 3.
Figure 8:
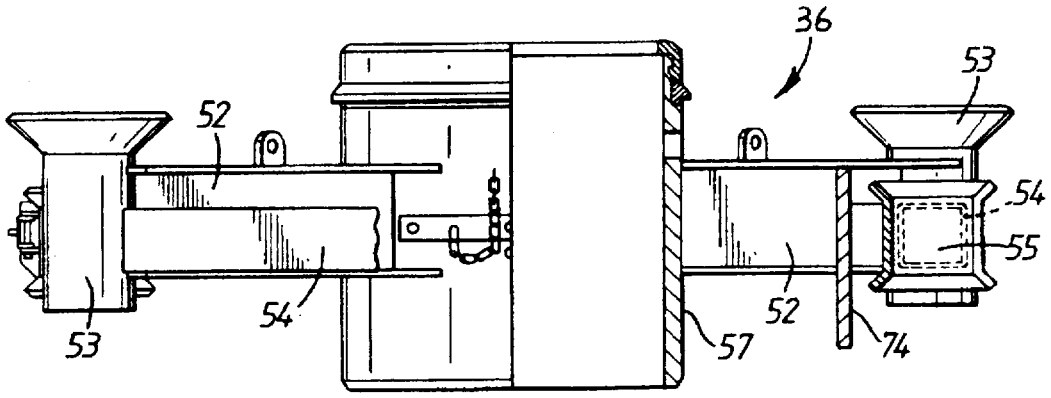
FIG. 8 is a section on the line VIII—VIII of FIG. 6.

FIG. 1 also shows a completion guidebase 36 on each hinge-over guidebase 22. A completion guidebase 36 is best seen in FIGS. 7 and 8. With reference to those Figures, the completion guidebase 36 comprises a central tube 51 connected by four equi-angularly spaced radially extending I-beams 52 to four guide funnels 53, each guide funnel 53 being at the end of a respective I-beam 52. The guide funnels 53 are interconnected by box beams 54 to give a square configuration. Two opposed box beams 54 are provided at their centers with respective guidewire tubes 55 extending parallel to the tube 51 and the funnels 53. Each guidewire tube 55 is provided with an axial slot 72 which can be opened and closed by a keeper 73 to allow a guidewire (not shown) to be inserted into the tube 55 and the tube 55 then closed.

The completion guidebase 36 also includes a locating plate 74 extending between two box beams 54 and running parallel to but spaced from a third fox beam 54 including a tube 55. The plate 74 lies in a vertical plane and, intermediate its ends, is provided with a downwardly directed guide slot (not shown) for a purpose to be described below.

The deployment of the system described above with reference to FIGS. 1 and 3 will be described with specific reference to FIGS. 4 to 6. The system is deployed from a semi-submersible vessel movably anchored (or dynamically positioned) at a required position over the seabed 15. Such vessels have the ability to lift onto the vessel loads of 20–30 tonnes (depending on sea conditions). The vessel includes a moonpool through which modules can be lowered to the seabed and through which drilling operations are performed using a derrick above the moonpool.

First, the temporary guidebase 20 is installed at the required position on the seabed 15. A hole is then drilled into the seabed 15 through the temporary guidebase 20 to receive the pile 14. The hole may, for example, be drilled using a drill bit having a diameter of 950 mm (36 inches). As mentioned above, the pile 14 may be 50 meters long and so the hold must be at least that length (it will usually be drilled through the soft surface layer).

The template 10 is then supported over the moonpool on a pair of support beams (not shown) of conventional type. A running frame 37 is then positioned on top of the template 10. The running frame 37 comprises a central tube 38 with upper and lower arms 40, 41 projecting from respective upper and lower ends of the tube 38 and from respective opposite sides of the tube 38. The ends of each pair of arms 40, 41 remote from the tube 38 carry a guidetube 42.

Upper and lower cross arms 45, 46 are carried by and extend normal to each pair of arms 40, 41. Each cross arm 45, 46 carries adjacent its end a latch 47 including a pin (not shown) that engages in a corresponding hole 44a in a flange 43 of the adjacent hinge-over guidebase 22, (when such a guidebase 22 is positioned as shown in FIGS. 4 to 6) so holding the guidebase 22 in the collapsed disposition shown in FIGS. 4 and 5.

Two further members 49 and 50 extend between two pairs of cross arms 45, 46 to one side of the tube 38, extend parallel to the arms 40 and carry latches 47 that engage holes 44 in the flanges 43 of the fifth guidebase.

Next guideposts are inserted through the running frame guide tubes 42 and are latched to respective guidepost receivers on the template 10. The guideposts are of a type that allow the guideposts to be released subsequently from engagement with the receivers. The upper end of each guidepost includes a connector which is then latched to a connector at the end of a guidewire running from the vessel.

Figure 4:
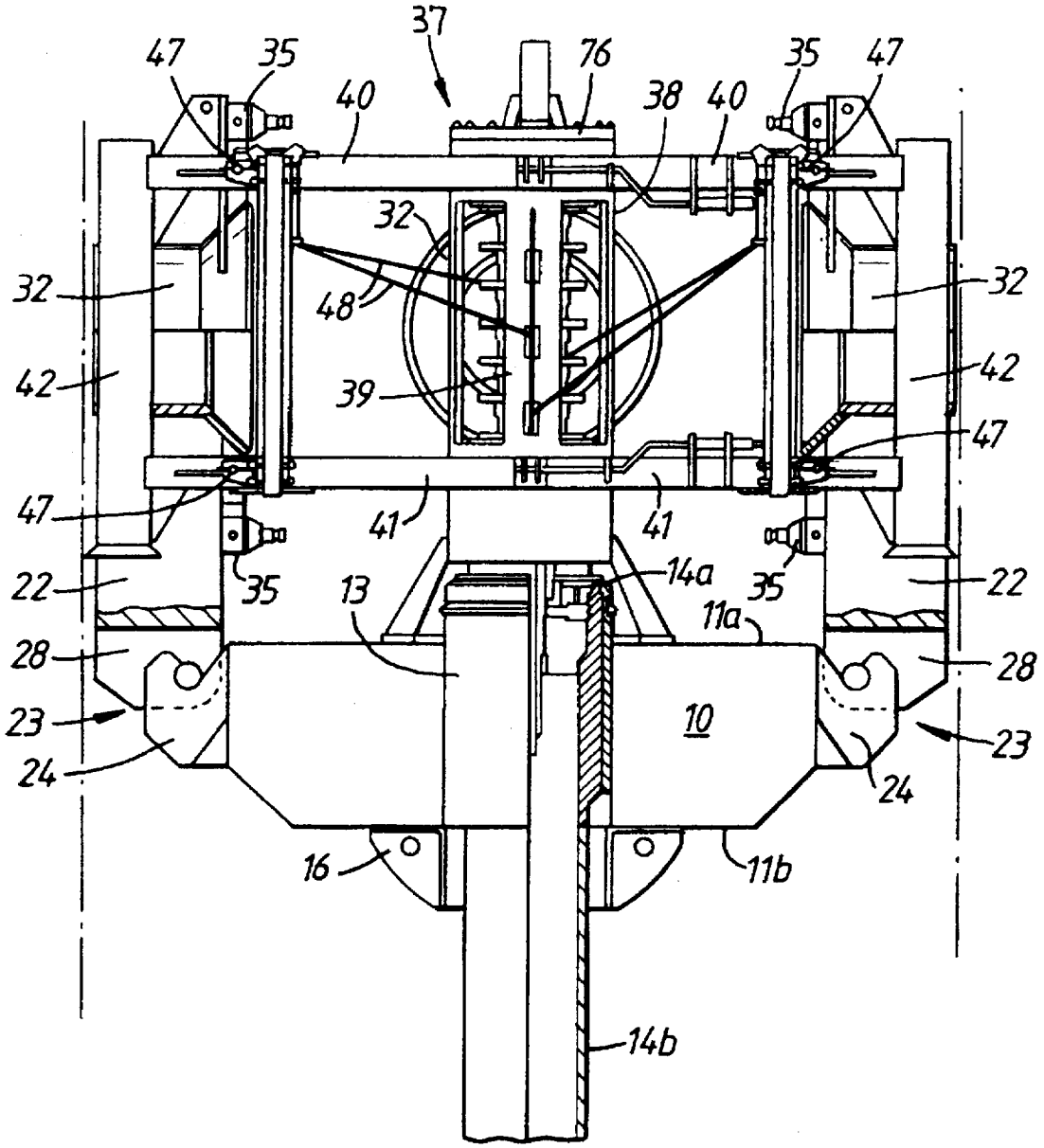
FIG. 4 is a side elevation in the direction of the arrow A in FIG. 5 of the system of FIGS. 1 to 3 in a collapsed disposition and carrying a running frame, the system being ready to be lowered through a moonpool of a semi-submersible vessel.
Figure 5:
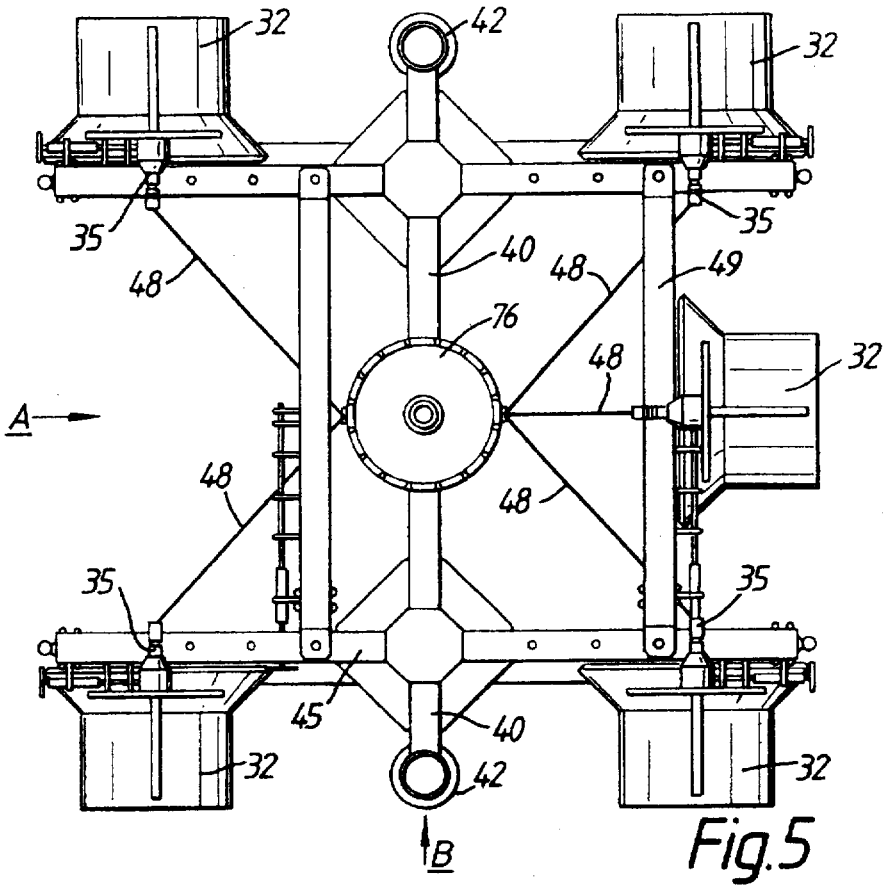
FIG. 5 is a plan view from above the system of FIG. 4 omitting the template.

The hinge-over guidebases 22 are then lifted and hinged on to the template 10 in their collapsed vertical disposition as shown in the FIGS. 4 and 5. As described above, they are hold in this position by engagement of the latches 47 in the holes 44 on the flanges 43 of the hinge-over guidebases 22.

When in the collapsed disposition shown in FIG. 4, the hinge-over guidebases 22 project only minimally laterally of the template 10 so that the maximum width of the system is sufficiently small to allow it to be lowered through the moonpool of the semi-submersible vessel. For example, a typical moonpool size may be 5.5 meters by 5.5 meters. Further, the weight of the system is such that it can be handled by the lifting equipment commonly provided on such semi-submersible vessels for lifting equipment onto the vessel which, as mentioned above, may be able to accommodate loads of 20 to 30 tonnes.

The pile 14b is then run through the pile housing receptacle 13 in the template 10 with the end of the pile 14b being welded to the pile housing 14a which latches in the receptacle 13. A running tool, whose end is shown in FIGS. 4 and 6, is connected to the pile housing 14a. Above the running tool is a spool 39 carrying cables 48 with each cable 48 being connected to a respective hinge-over guidebase 22 via a shackle connected to a respective hall 44b in a flange 43. The cables 48 are tensioned by rotation of the spool 39. A centralizer end plate 76 is bolted to the end of the tube 38 of the running frame 37.

The system is lowered to the seabed 15 by the running tool and drill pipe centralizer. The pile 14 enters the drilled hole through the temporary guidebase 20 until the gimbal 16 on the template 10 engages the frustoconical surface 19 on the temporary guidebase 20. The level of the template 10 is also checked and, using the gimbal 16, the level is adjusted as necessary. The pile 14 is then cemented in the drilled hole.

A remotely operated vehicle (ROV) is then maneuvered to release the pins of the latches 47. The drill pipe is rotated to rotate the spool 39 so untensioning the cables 48 to allow the guidebases 22 to swing downwardly until they project laterally from the template 10 as shown in FIG. 1. When in the laterally projecting position, the hinge 23 are locked by locks (not shown in FIGS. 1 to 6).

While the pile 14 is being cemented, the template 10 is supported by the temporary guidebase 20. However, the temporary guidebase 20 and the gimbal 16 could be omitted and the system held on the drill string while cementing occurs.

The running tool is withdrawn to the surface with the running frame 37. The shackles are provided with shear pins that break during this operation so disconnecting the cables 48 from the templates 22. The guideposts remain on the template 10 connected to the vessel by wires.

It will be appreciated that the running frame 37 is not connected to the template 10. It would be possible, therefore, to deploy the template 10 on the seabed 15 independently of the running frame 37 and the hinge-over guidebases 22 and then mount the hinge-over guidebase 22 on the running frame 37 as described above before lowering the assembly onto the template 10. The hinge pads 28 on the guidebases 22 will then connect with respective hinge pads 24 on the template 10 as the assembly reaches the template 10.

The next stage is the drilling of a well and this is done through a selected hinge-over guidebase 22. This is achieved in the following way.

The ROV first unlatches the two guidewires from the template 10 and latches them to the respective connectors 35 on selected hinge-over guidebases 22. The semi-submersible vessel is then moved until the moonpool is over the selected hinge-over guidebase 22. Using the guidewires and a softline, a 950 mm (36 inches) drill bit is run through the centralizer 32 of the nominated hinge-over guidebase 22 and a 950 mm (36 inches) conductor pipe hole is drilled through the seabed 15. Next, a completion guidebase 36 is mounted on the hinge-over guidebase 22 in the following way.

The completion guidebase 36 is lifted onto the support beams over the moonpool and the guidewires from the hinge-over guidebase 22 are passed through the guidewire tubes 55. A guidepost 80 is releasably connected to each of the guide funnels 53. The guideposts 80 may be the same as the guideposts used on the template 10. A male connector 81 at the upper end of each guidepost 80 is connected to a female connector at the end of a guidewire. A conductor pipe 56 is run through the tube 51 with a housing 78 at the end which is latched to the end of the tube 51. A running tool (not shown) is then connected to the housing 78 and the completion guidebase 36 and the conductor pipe 56 are then run to the guidebase 22. The guidewire tubes 55 fit over the locating lugs 35 to locate the completion guidebase 36 on the hinge-over guidebase 22 and the guide slot on the locating plate 74 engages the machined flange portion 43a to fix the orientation of the completion guidebase 36 relative to the hinge-over guidebase 22. The conductor pipe is then cemented in position. The two previously installed guidewires can then be released by an overpull to shear the pins 69 holding the locating lugs 35 on the guidebase 22.

The well is now ready to complete further drilling using standard drilling operations.

Figure 9:
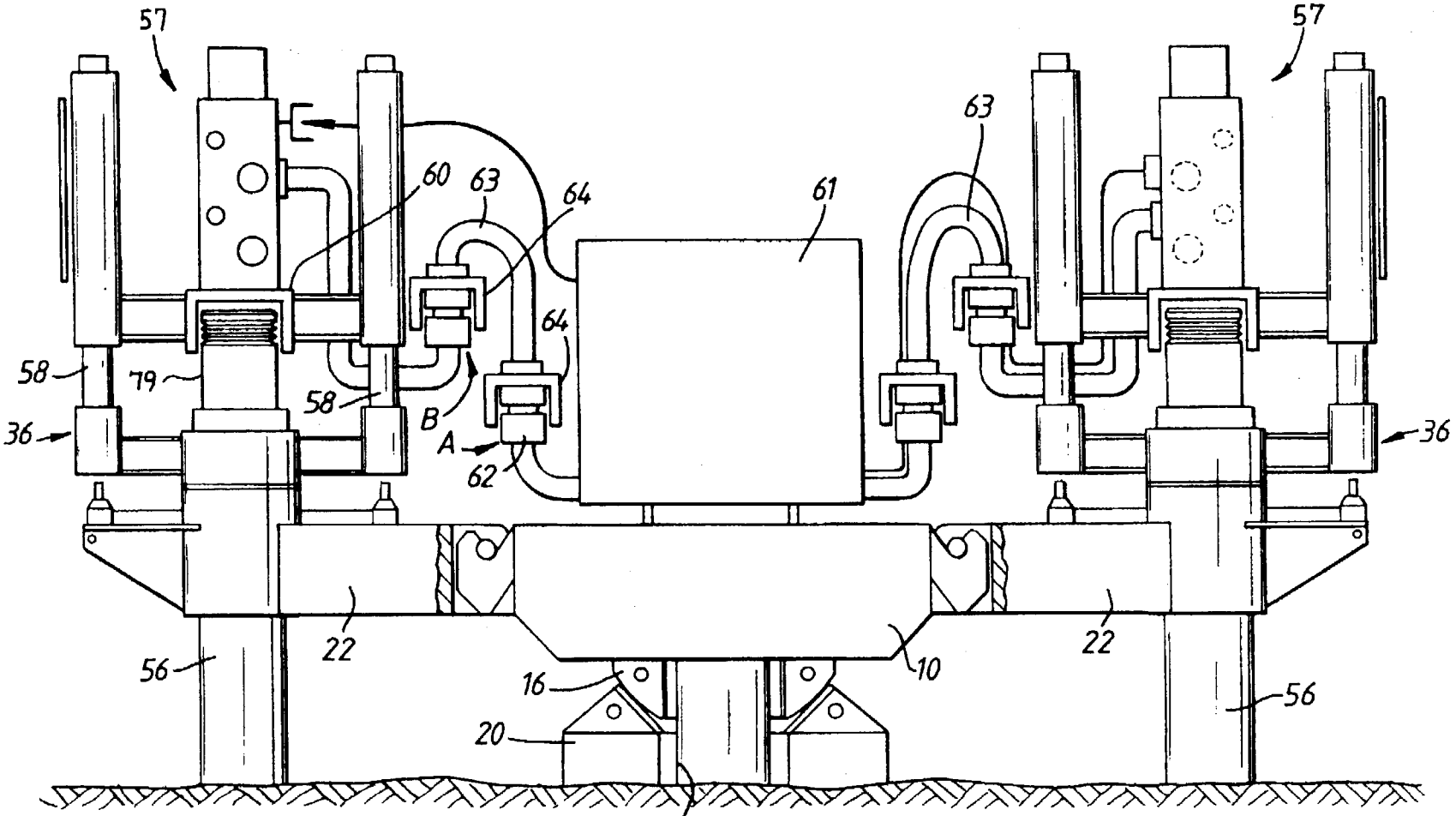
FIG. 9 is a schematic side elevation of the system of FIG. 1 showing christmas trees on the completion guide bases, a manifold on the template and connections between the manifold and the christmas trees.

Once wells have been drilled, the production/completion equipment can be installed. One example of such an arrangement is shown schematically in FIG. 9. In this Figure, parts common to FIGS. 1 to 5 and this Figure will be given the same reference numerals and will not be described in detail.

In this arrangement, each well is provided with a christmas tree 57 having tubes 58 that fit over respective ones of the guideposts 80 on the associated completion guidebase 36. Each christmas tree 57 is provided with a connector 60 which latches the christmas tree to the wellhead 79. The christmas tree 57 is positioned onto the completion guidebase 36 using the wires connected to ends of the guideposts 80.

A manifold 61 is carried on the template 10 and is provided with a connector 62. The manifold 61 can be positioned using wires attached to guideposts on the template 10. The christmas tree outlet B and the manifold outlet A are interconnected by a retrievable U-shaped bridge 63 positioned by using guidewires. As seen, the ends of both the outlets A, B face vertically upwardly and project into downwardly facing female connections 64 on the bridge 63.

The bridge 63 will include a hydraulic locking device that makes the connection between these parts.

It will be appreciated that the interconnection need not be made as described above. One outlet A or B may be provided with a male connection part arranged vertically upwardly while the other outlet A or B is provided with the female connection facing vertically downwardly so that, as the parts are positioned the connection is made. Alternatively, the ends of the outlets A, B may be arranged horizontally and a horizontal connection be provided between them.

The whole system may be provided with a protective structure (not shown) which will allow the system to be protected from trawler equipment.

It will be appreciated that second and subsequent wells may be drilled using second and subsequent hinge-over guidebases 22. In such a case, two of the wires attached to the posts 80 on the completion guidebase 36 will be unlatched by an ROV and connected to respective connectors 35 on the sleeted hinge-over guidebase 22. The procedure will then be as described above.

Figure 11:
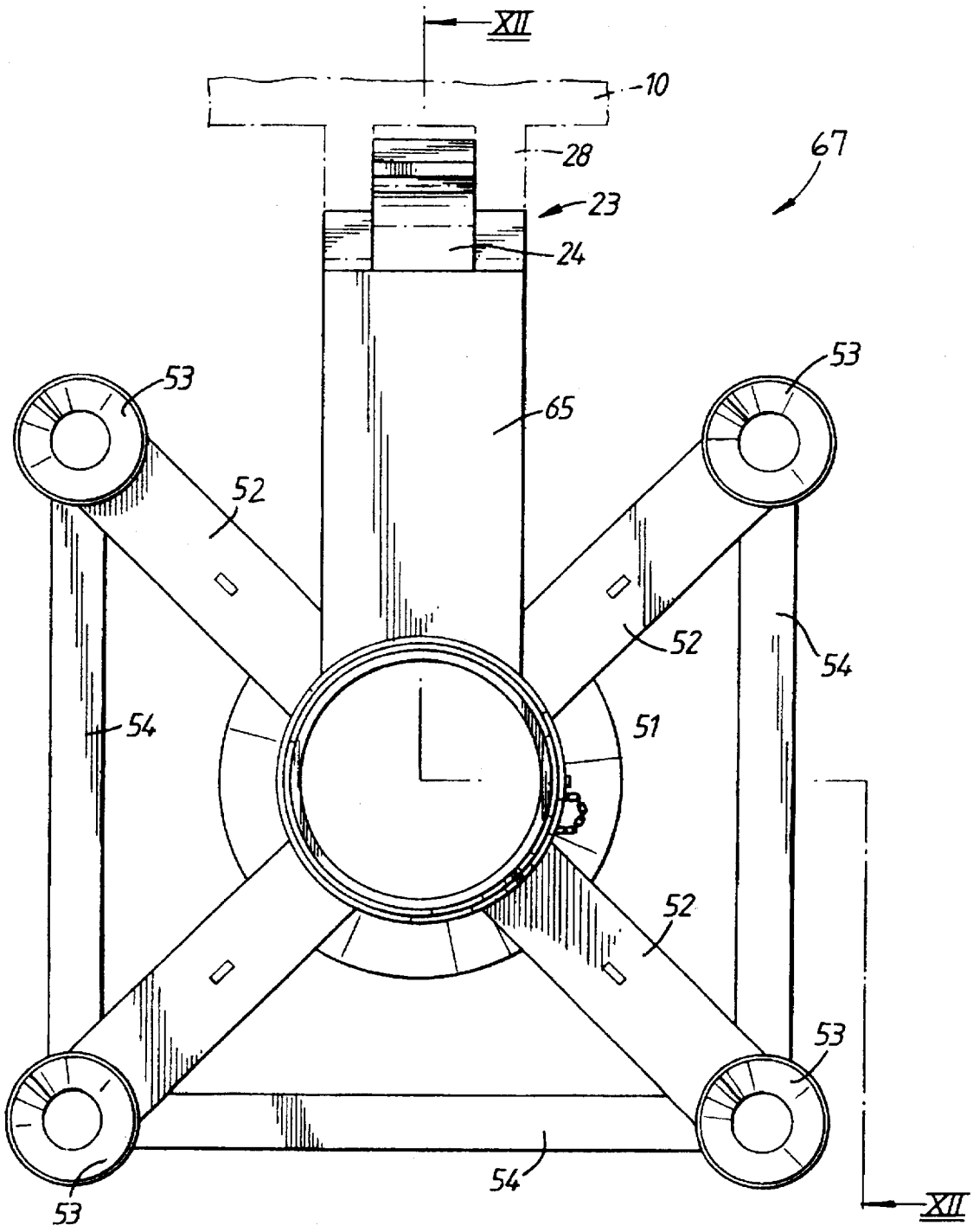
FIG. 11 is a plan view from above of the modified completion guidebase of FIG. 8.
Figure 12:
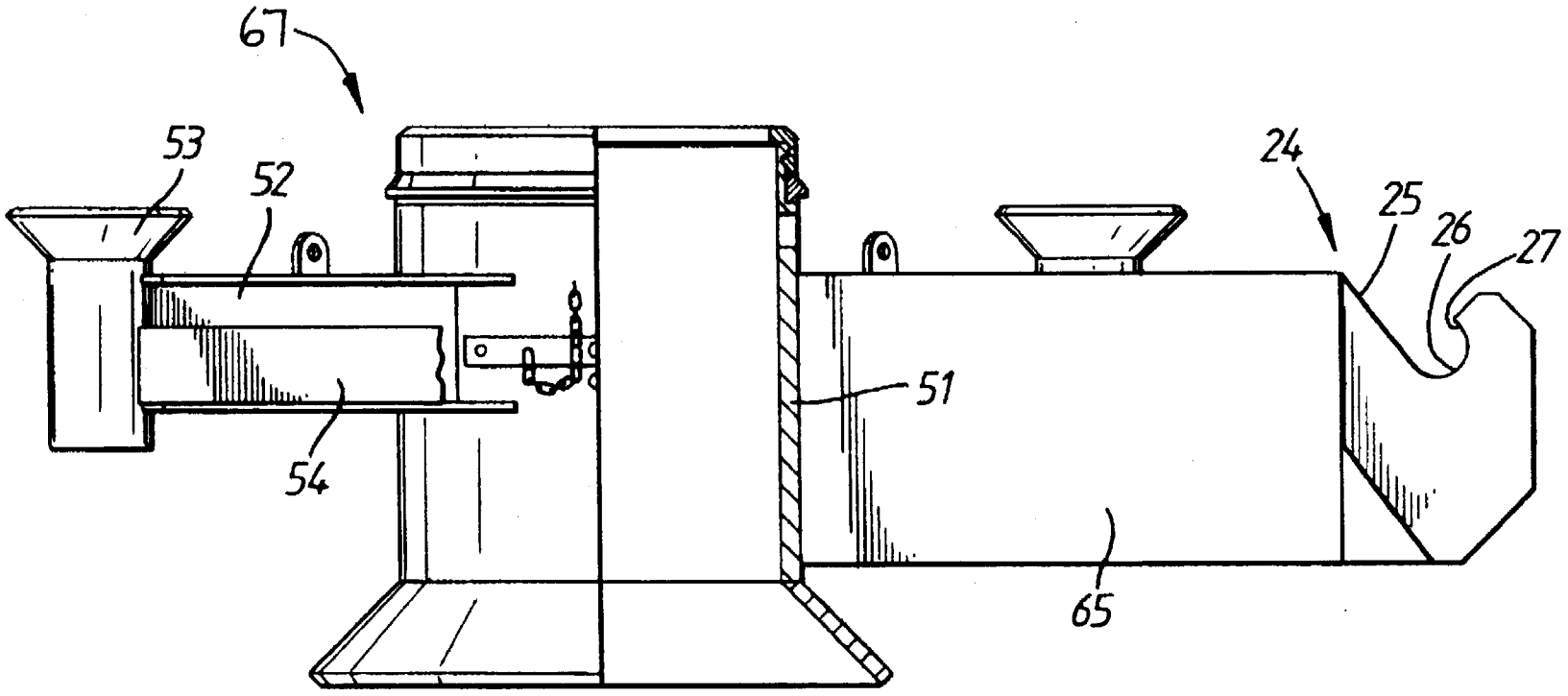
FIG. 12 is a section on the line XII—XII of FIG. 11, FIGS. 13*a*, 13*b* and 13*c* show three alternative ways of engaging a module with a template via a hinge.

The system described above is for drilling new wells. It is also possible to adapt the system to incorporate an existing well. Such a system will now be described with reference to FIGS. 10, 11 and 12. Parts common to these Figures and to FIGS. 1 to 7 will be given the same reference numerals and will not be described in detail.

Figure 6:
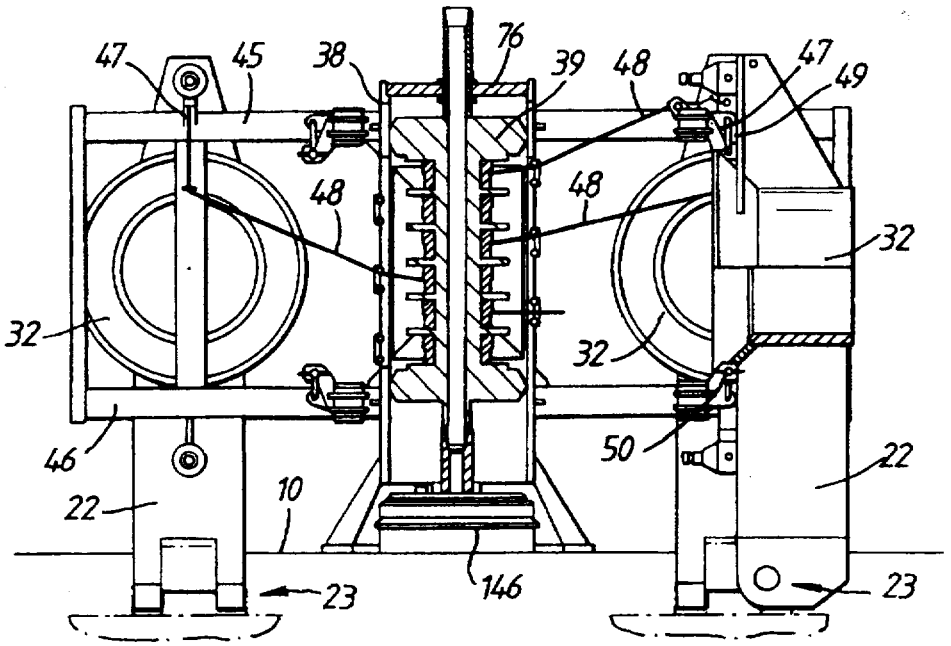
FIG. 6 is a similar view to FIG. 4 but in the direction of the arrow B in FIG. 5 and with the system partly cut-away.

The system utilizes a modified form of the completion guidebase 36 shown most clearly in FIGS. 6 and 7. However, one of the box beams 54 is omitted as are both of the guidewire tubes 55. A hinge beam 65 extends radially from the tube 51 and equi-angularly spaced from the two adjacent I-beams 52 which are unconnected by a box beam 54. The end of the hinge beam 65 remote from the tube 51 is provided with a hook-shaped hinge part 24 which is the same as the hook-shaped hinge part 24 on the template of FIGS. 1 to 7.

The modified completion guidebase 67 is positioned as follows.

First, the existing guidebase from the existing well is removed and the housing of the conductor pipe inspected for damage. The modified completion guidebase 67 is then lifted over the moonpool and using a drill pipe tool is lowered onto the existing well using guideposts and guidewires in the same way as the completion guidebase 36. The tube 51 is then latched on to the existing well head.

Next, a template 10 is lifted over the moonpool. The template is the same as that described above with reference to FIGS. 1 to 3 except that one of the hinge parts on the template is formed by a bar 29 between plates 30 in the manner of the hinge part 28 on the hinge-over guidebase 22 described above with reference to FIGS. 1 to 3. Accordingly, this hinge part 28 on the template 10 and the associated hinge part 24 on the modified completion guidebase 67 are reversed as compared to the remaining hinges 23.

The template 10 is then slung in a special frame and lowered to the seabed 15 guided by wires with the bar 29 aligned with the hinge part 24 on the modified completion guidebase 67. As the template 10 reaches the modified completion guidebase 67, the bar engages the sloping surface 25 and is guided into the eye 26. Further lowering of the template 10 causes the template 10 to pivot about the bar 29 into a horizontal disposition.

Figure 10:
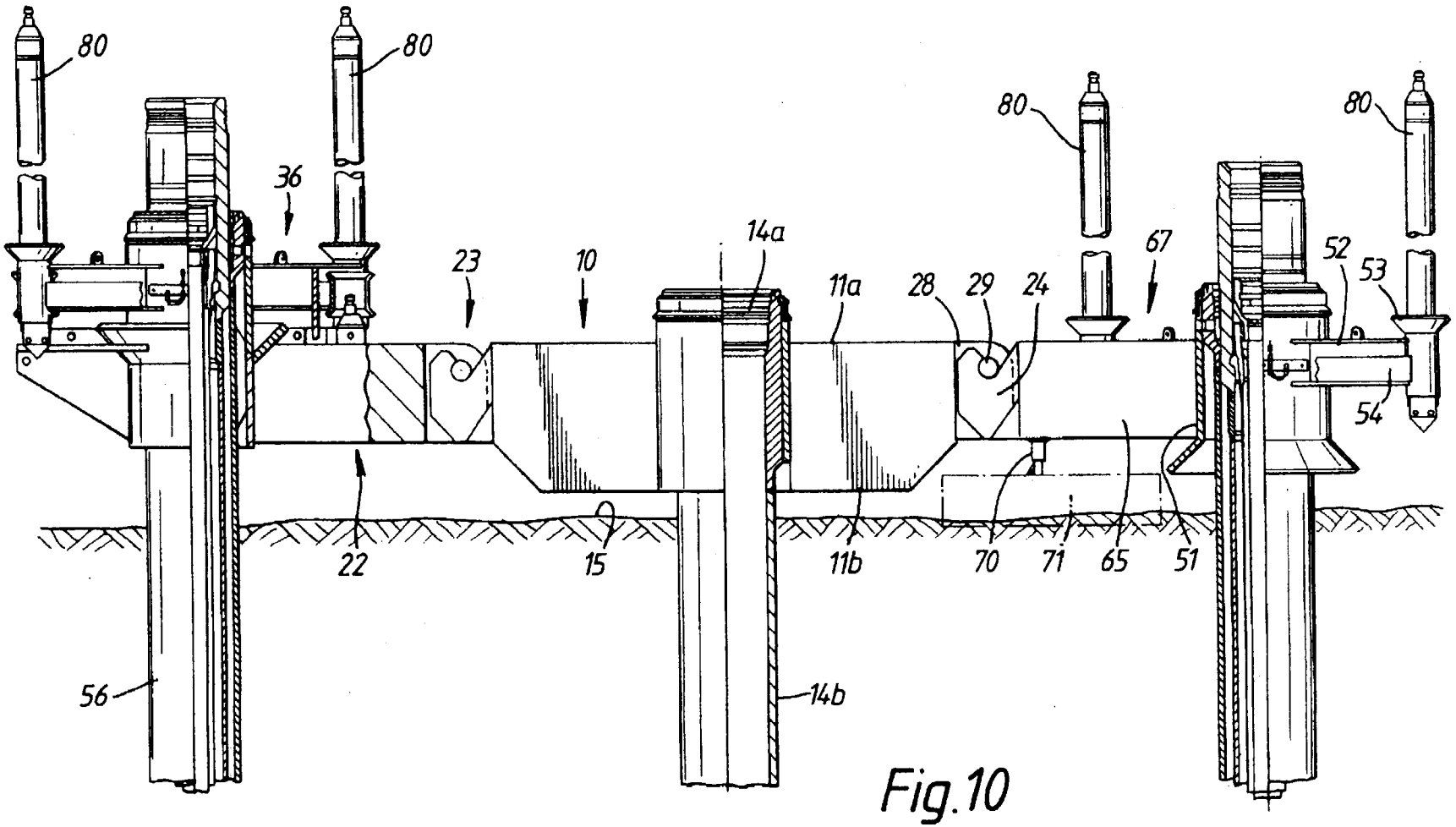
FIG. 10 is a side elevation of a second form of template system disposed on the seabed, the system including a modified completion guidebase connected to an existing completed well.

It may be necessary to use jacks and mud mats to level the central structure prior to any further work. One example of this is shown in FIG. 10 where a jack 70 is mounted on a mud mat 71 to support the hinge beam 65 of the modified completion guidebase 67.

The template 10 is then disconnected from the lifting gear and the wires and guideposts from the modified completion guidebase 67 are transferred to the template 10 by a remotely operated vehicle. Using the pile housing receptacle 13 as a drilling template, a hole is drilled through the template 10 using drilling centralizers. As before, the diameter of the hole may be 950 mm (36 inches). Once drilled, a pile 14 whose diameter may be 762 mm (30 inches) is then run to the seabed 15 using the running tool and latched to the pile housing 13. The pile 14 is then cemented in position and the tool retrieved.

After this, hinge-over guidecases 22 can be connected to the template 10 by being lowered through the moonpool on the running frame and the hinge parts interconnected. The hinge-over guidebases 22 can then be used for drilling a conductor pipe hole as described above with reference to FIGS. 1 to 7.

Figure 13A:
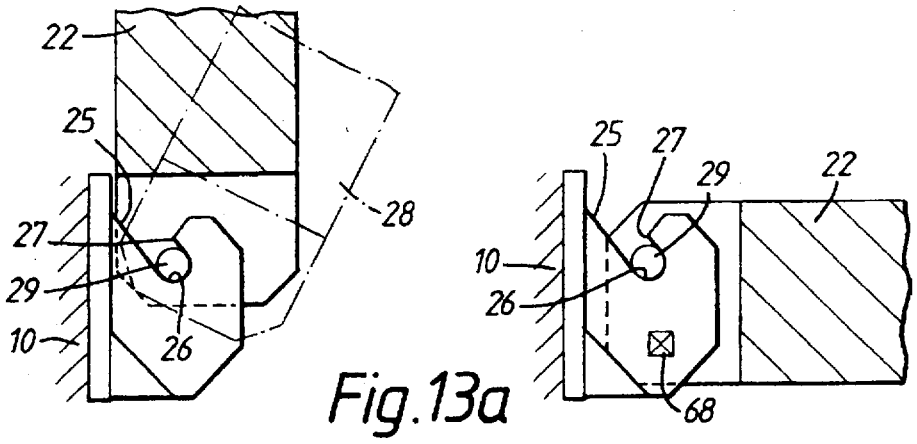
Figure 13B:
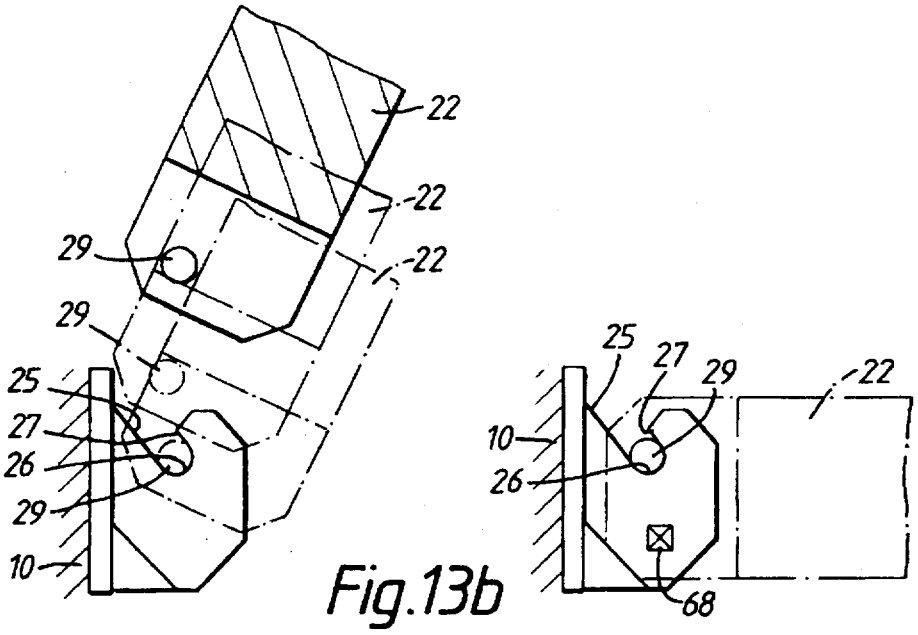
Figure 13C:
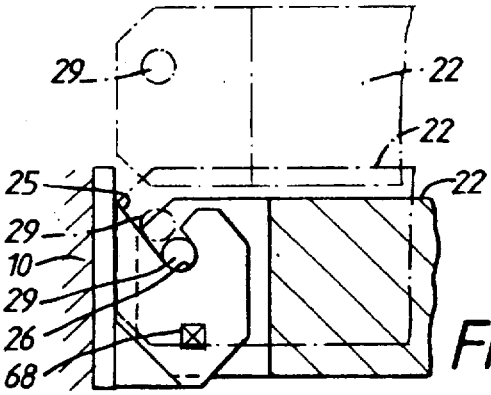

As described above, the interconnections between the template 10 and the side modules (the hinge-over guidebases 22 or the modified completion guidebase 67) are made via the hinge 23. FIGS. 13*a*, 13*b* and 13*c* show how a hinge 23 of the kind described above with reference to the drawing can accommodate various approaches to interconnection. In these Figures, parts common to the Figures and to FIGS. 1 to 3 will not be described in detail and will be given the same reference numerals.

As shown to the left in FIG. 13*a*, the hinge parts 24, 28 can be interconnected with the hinge-over guidebase 22 in the angled position shown in broken line in FIG. 13*a*. The hinge-over guidebase 22 can then be pivoted to the vertical position shown in full line with disengagement between the bar 29 and the eye 26 being prevented by the tangential surface 27.

As shown to the right-hand side of FIG. 13*a*, the hinge-over guidebase 22 can subsequently be pivoted from the vertical disposition to a horizontal position in which it extends laterally from the template 10. A hinge lock 68 is provided to hold the parts in this relative disposition.

Referring next to FIG. 13*b*, the left-hand side of this Figure shows how the hinge-over guidebase 22 can be connected to the template 10 by the hinge part 28 being lowered on to the hinge part 24 with the hinge-over guidebase 22 inclined at an acute angle away from the template 10. In this case, the bar 29 engages the sloping surface 25 and is then guided down into the eye 26. Further downward movement of the hinge-over guidebase 22 causes the hinge-over guidebase 22 to pivot about the bar 29 into the horizontal disposition in which it is locked by the lock 68.

Referring next to FIG. 13*c*, the hinge-over guidebase 22 can approach the template in a horizontal disposition when, against the bar 29 will contact the sloping surface 25 and be guided into the eye 26. The lock 68 will then lock the parts together.

Although these interconnection modes have been described for a hinge-over guidebase 22, it will be appreciated that they can be used for any module including a hinge part interconnectable to the template 10.

For example, a hinge part 28 or 24 could be provided on a module carrying a flowline pull-in porch incorporating a ramp. Alternatively, a hinge part 28 could be provided on one of a number of flowline units. A hinge part 28 may be provided on a base for carrying a pig launcher. Such a pig launcher may be connected to a manifold 61 of the kind described above. The module may, for example, provide a platform of similar area to the template 10.

These possibilities allow template systems of the kind described above to be used in a number of configurations. For example, one of the hinges on the template 10 could be used to carry a flowline pull-in porch for connecting the manifold 61 on the template to a remote single well. The remaining hinges on the template 10 would still carry hinge-over guidebases 22 for drilling wells. Alternatively, all the hinged parts 24 on the template could carry flowline pull-in porches and be connected individually to remote wells. The manifolds of two or more templates could be connected in series with modules on the templates providing the necessary flowline guidance. Alternatively, the modules of a number of templates 10 could be connected to a central module with, again, each template providing the necessary flowline guidance.

The embodiments described above with reference to the drawing have the advantage that the system can be deployed through the moonpool of a semi-submersible vehicle so requiring no heavy lifting barge for their deployment. In addition, the deployment requires no divers; at most requiring only the use of a remotely operated vehicle, although in some instances even the use of such a vehicle may be able to be avoided.

The use of the hinge-over guidebases 22 allows commencement of the drilling of the well before the christmas trees and manifold have been constructed. This reduces significantly the time taken to bring a well into production.

All the basic systems can be retrieved independently of the template. The piles 14 can be cut beneath the template 10 by a variety of techniques and beneath the hinge-over guidebases 22 again using a variety of techniques allowing these parts to be retrieved.

The template 10 described above with reference to the drawings is generally square in plan view. It will be appreciated that it may be any suitable shape, for example hexagonal. The square shape has the advantage however that once the moonpool of the vessel (which is generally square) is in register with the template 10, it can be brought into register with the modules without the need to rotate the vessel.

While the preferred embodiment of the invention has been herein shown and described, it is understood that variation and modification of the invention can be made without departing from what is regarded as the scope of the invention.

What is claimed is:

1. A subsea system comprising a template having an upper support for equipment and a mounting for landing the template to a base located on a seabed, the template including at least one hinge member for connection to a module such that the module can be pivoted relative to the template from a collapsed disposition to a deployed disposition, wherein the base supports both the template and the module at an elevation above the seabed.

2. A system according to claim 1 wherein said hinge member comprises a hinge part for connection to a second hinge part on a module to form a hinge.

3. A system according to claim 2 wherein the hinge member provides a pivot about an axis lying in a plane parallel to the plane of the template.

4. A system according to claim 3 wherein the template is generally rectangular in plan, each edge including at least one of said hinge members.

5. A hinge according to claim 4 wherein at least two opposed edges each have two hinge members spaced along said edge.

6. A subsea system comprising a template having an upper support for equipment and a mounting for landing the template to a base located on a seabed, the template including at least one hinge member for connection to a module such that the module can be pivoted relative to the template from a collapsed disposition to a deployed disposition, wherein the base supports both the template and the module above the seabed;

said hinge member comprising a hinge part for connection to a second hinge part on the module to form a hinge;

wherein the hinge member provides a pivot about an axis lying in a plane parallel to the plane of the template;

the template being generally rectangular in plan and each edge including at least one of said hinge members; and a running frame, the running frame including latching means for releasably engaging a module in a collapsed disposition.

7. A system according to claim 6 wherein the running frame includes means for engaging at least two guidewires for positioning the running frame on the seabed.

8. A system according to claim 7 wherein the template mounting comprises an aperture for receiving and engaging a pile housing at an end of a pile, the pile being fixed in a hole in the seabed to provide a support for the template.

9. A system according to claim 8 wherein the template has a lower surface, said lower surface carrying a gimbal for allowing the plane of the template to be adjusted relative to the seabed.

10. A system according to claim 9 in conjunction with at least one module, the module including at a periphery thereof a second hinge member which co-operates with a template hinge member to permit pivotal movement of the module between said collapsed and deployed dispositions.

11. A subsea system comprising a template having an upper support for equipment and a mounting for landing the template to a base, the template including at least one hinge member for connection to a module such that the module can be pivoted relative to the template from a collapsed disposition to a deployed disposition;

wherein said hinge member comprises a hinge part for connection to a second hinge part on a module to form a hinge;

wherein the hinge member provides a pivot about an axis lying in a plane parallel to the plane of the template;

wherein the template is generally rectangular in plan, each edge including at least one of said hinge members;

wherein at least two opposed edges each have two hinge members spaced along said edge;

the system further comprising a running frame, the running frame including latching means for releasably engaging a module in a collapsed disposition;

wherein the running frame includes means for engaging at least two guidewires for positioning the running frame on the seabed;

wherein the template mounting comprises an aperture for receiving and engaging a pile housing at an end of a pile, the pile being fixed in a hole in the seabed to provide a support for the template;

wherein the template has a lower surface, said lower surface carrying a gimbal for allowing the plane of the template to be adjusted relative to the seabed;

wherein the module includes at a periphery thereof a second hinge member which co-operates with a template hinge member to permit pivotal movement of the module between said collapsed and deployed dispositions; and wherein one hinge part comprises a hook-shaped member having a guide surface leading to an eye of the hook-shape, the other hinge part comprising a circular cross-section bar so arranged that the bar is engagable with the guide surface with the module oriented relative to the template at any position between the deployed position and a position at an acute angle to said deployed position, the guide surface then guiding the bar into the eye to form a hinge.

12. A system according to claim 11 wherein the hinge parts cooperate to prevent the module from moving beyond the deployed disposition from the collapsed disposition.

13. A system according to claim 12 wherein the hook-shaped hinge part is associated with a stop lying in a plane parallel to the hinge axis, the bar being associated with a projection that engages said stop when the module is in said deployed disposition to prevent said movement beyond said disposition.

14. A system according to claim 13 wherein the hinge parts include a lock for locking the hinge parts together when the module is in the deployed disposition.

15. A system according to claim 14 wherein the template is generally rectangular in plan with four side edges, opposed two of said side edges including two hinge members with a module pivotally connected to each said hinge member and the two remaining side edges having a single hinge member with a single module pivotally connected thereto.

16. A system according to claim 15 wherein the modules are generally rectangular in plan with side edges parallel to the side edges of the template.

17. A system according to claim 16 wherein the two rectangular modules pivoted to each of said two opposed side edges project laterally beyond the adjacent remaining side edges.

18. A system according to claim 14 wherein the module comprises a hinge-over guidebase including a drilling guide.

19. A system according to claim 18 wherein the hinge-over guidebase includes a mounting for a completions guidebase.

20. A system according to claim 19 wherein the hinge-over guidebase includes an anchor for two guidewires, the system also including a completions guidebase having guidewire tubes through which the guidewires run to allow the completions guidebase to be located on the hinge-over guidebase.

21. A system according to claim 14 wherein the template carries a manifold.

22. A system according to claim 21 wherein the manifold includes at least one fluid connector part for co-operation with another fluid connector part on other equipment carried by a module, the connector parts being engagable automatically to make the connection as the equipment is deployed on the module.

23. A system according to claim 14 wherein the hook-shaped hinge member is carried on the module and the bar is carried on the template, the module being for connection to an existing well with the template being positioned on the seabed subsequently and the bar engaged with the hook-shaped hinge member to form said hinge as the template is positioned.

24. A system according to claim 23 together with a cage covering the system.

25. A method of deploying a subsea system comprising, arranging a template over a moonpool of a vessel, lowering the template to the seabed through the moonpool, supporting the template above the seabed and then arranging a module to project laterally from the template via a hinged connection therebetween in a generally hinged laterally projecting position at an elevation above the seabed.

26. A method according to claim 25 and comprising mounting the template on the seabed and engaging the module in said hinged laterally projecting position.

27. A method according to claim 26 wherein the module is engaged with the template in a disposition angularly spaced from said laterally projecting position and is then pivoted about said hinged connection to said laterally projecting position.

28. A method according to claim 27 wherein the module is engaged with said template when in said laterally projecting position.

29. A method according to claim 25 wherein the module is hinged to the template as the template is positioned over the moonpool, the module being positioned in a collapsed disposition in which the module projects minimally laterally of the template, the module of the template being lowered together through the moonpool and the module being subsequently pivoted to said laterally projecting position.

30. A method of deploying a subsea system comprising arranging a template over a moonpool of a vessel, lowering the template to the seabed through the moonpool and then arranging a module to project laterally from the template via a hinged connection therebetween in a generally hinged laterally projecting position;

mounting the template on the seabed and engaging the module in said hinged laterally projecting position;

wherein the module is engaged with the template in a disposition angularly spaced from said laterally projecting position and is then pivoted about said hinged connection to said laterally projecting position;

wherein the module is engaged with said template when in said laterally projecting disposition; and hinging at least one module to the template while the template is over the moonpool, attaching a running frame to the at least one module to hold the module in the collapsed disposition, attaching guidewires to the template, attaching a drill string to the template and then lowering the template to the seabed using said drill string.

31. A method according to claim 30 and comprising drilling a hole in the seabed, attaching a depending pipe to the template while the template is over the moonpool and then lowering the pipe into the hole and fixing the pipe in the hole to provide a mounting for the template and the module.

32. A method according to claim 31 wherein the module is a hinge-over guidebase, the method comprising positioning the moonpool over the hinge-over guidebase when the hinge-over guidebase is in the laterally projecting position and then drilling a hole with the drill pipe being guided by said hinge-over guidebase.

33. A method according to claim 32 and comprising subsequently positioning a completion guidebase over the moonpool, attaching a conductor pipe to the completion guidebase and then positioning the completion guidebase on the hinge-over guidebase with a conductor pipe extending through the hinge-over guidebase.

34. A method according to claim 33 and comprising fixing guidewires between the hinge-over guidebase and the vessel and then engaging the wires with guides on the completion guidebase to guide the completion guidebase onto the hinge-over guidebase.

35. A method according to claim 34 and comprising connecting wires between the vessel and the template when the template is over the moonpool, and disconnecting said guidewires when the template is on the seabed and connecting said guidewires to the hinge-over template.

36. A method according to claim 35 and comprising connecting two or more guidewires between the completion guidebase and the vessel before the completion guidebase is mounted on the hinge-over guidebase, the guidewires being for guiding equipment onto said completion guidebase from the vessel.

37. A method of deploying a subsea system comprising arranging a template over a moonpool of a vessel, lowering the template to the seabed through the moonpool and then arranging a module to project laterally from the template via a hinged connection therebetween; and connecting a module to an existing wellhead and positioning the template on the seabed, the template being hinged connected to the module as the template is so positioned so that the module projects laterally from the template.

38. A method according to claim 37 and comprising attaching subsequently to the template at least one additional module.

39. A subsea template system to facilitate the drilling and completion of a subsea well comprising:

a central template;

means for supporting the template at an elevation above a seabed;

at least one guidebase through which a subsea well may be drilled; and means for hinged connecting the guidebase to the template and for maintaining the guidebase in an approximately horizontal position;

whereby the guidebase is supported in an approximately horizontal position at an elevation above the seabed.

40. The system of claim 39, wherein the means for supporting comprises a pile.

41. The system of claim 40, wherein the means for supporting further comprises a pile housing attached to the pile and the template comprises a receptacle which is adapted to be connected to the pile housing.

42. The system of claim 39, wherein the means for hinged connecting comprises a bar connected to the template and a hook connected to the guidebase which is adapted to pivotably engage the bar.

43. The system of claim 42, wherein the hook comprises an opening through which the bar may pass, wherein the guidebase is removably connectable to the template.

* * * * *